United States Patent [19]

Sakai et al.

[11] Patent Number: 4,705,926

[45] Date of Patent: Nov. 10, 1987

[54] ELECTRONIC CONTROL COOKING APPARATUS

[75] Inventors: Haruo Sakai; Kiyoshi Hiejima, both of Ohtsu, Japan

[73] Assignee: Sanyo Electric Co., Ltd., Osaka, Japan

[21] Appl. No.: 803,411

[22] Filed: Dec. 2, 1985

[30] Foreign Application Priority Data

Dec. 3, 1984 [JP] Japan ..... 59-255492

[51] Int. Cl.[4] ..... H05B 6/68

[52] U.S. Cl. ..... 219/10.55 B; 219/492; 99/325

[58] Field of Search ..... 219/10.55 B, 10.55 C, 219/10.55 R, 492, 506; 340/652, 654, 655; 99/325

[56] References Cited

U.S. PATENT DOCUMENTS

| | | | |
|---|---|---|---|
| 4,255,639 | 3/1981 | Kawabata et al. | 219/10.55 B |
| 4,425,490 | 1/1984 | Takeda et al. | 219/10.55 B |
| 4,453,066 | 6/1984 | Mori | 219/10.55 B X |
| 4,517,431 | 5/1985 | Ueda | 219/10.55 B |
| 4,520,251 | 5/1985 | Yokozeki | 219/10.55 B X |

*Primary Examiner*—Philip H. Leung

*Attorney, Agent, or Firm*—Handal & Morofsky

[57] ABSTRACT

An electronic control cooking apparatus, such as a microwave oven, when a thawing program comprising a plurality of heating stages is executed, once interrupts the execution of the thawing program at the time of completion of a first heating stage so as to interrupt the heating for food under thawing operation. During the interruption of heating, a user turns over the food and restarts the thawing operation to execute the process from a second heating stage in the thawing program, whereby the thawing process free from non-uniformity is easy to execute in a relatively short time.

17 Claims, 5 Drawing Figures

ELECTRONIC CONTROL COOKING APPARATUS

BACKGROUND OF THE INVENTION

1. Field of the Invention

The present invention relates to an electronic control cooking apparatus, such as a microwave oven and the like, employing a microcomputer as a controller.

Recently, as to, for example, a microwave oven, the food-thawing technology has remarkably been improved. Such food-thawing technology is disclosed in the Japanese Patent Application Laid-Open No. 52 (1977)-133151 (U.S. Pat. No. 4,255,639). In detail, a thawing program is composed of two heating stages, and a heating interruption duration is set between the two heating stages. The first heating stage is carried out with high power microwave energy (output) and the second one is carried out with low output heating. At the heating interruption duration, the non-uniformed thawing caused during the first heating stage is eliminated. To be more preceisely, if the non-uniformed thawing occurs after the first heating stage ends, there is a mixture of high temperature portions and low temperature portions inside the food, but during the interruption duration of the heating, the heat transmits from the high temperature portions to the low temperature portions, thereby eliminating the thawing non-uniformity. The trouble is that the heating interruption duration is relatively long and the entire thawing takes much more time.

In the light of such circumstance, the inventors have found after various experiments and examinations that in the case where the food to be thawed is subjected to a process of turning-over between the first and the second heating stages, it is fully thawed without any non-uniformity even for a shorter interruption duration of the heating.

A proper operation for thawing the food on the basis of the above result is as follows: Upon comleting the first heating stage, execution of the recipe program for the thawing is interrupted and thereafter the food is turned over to conduct the re-heating operation, so that the recipe program is restarted so as to execute the second heating stage. In such control, however, if a user forgets the turn-over process and also the cooking restarting, the second heating stage is not started even after the lapse of time from completion of the first heating stage, whereby the thawing scarcely is carried out.

OBJECT OF THE INVENTION

In the light of the above problem, the present invention has been designed.

A first object of the invention is to provide an electronic control cooking apparatus by which the refrigerated food, such as meat or fish, can be thawed without non-uniformity.

A second object of the invention is to provide an electronic control cooking apparatus which once interrupts the heating process on the way of thawing and heating, at which time the user turns over the food and restarts the heating, thereby enabling meat or fish to be thawed without non-uniformity in a relatively short time.

A third object of the invention is to provide an electronic contorl cooking apparatus which automatically restarts the heating after a predetermined time even when the user does not turn over the food and restart the next heating of the food during the interruption duration of the heating for turning over the food on the way of thawing and heating, thus relatively taking time, but performing the thawing free from non-uniformity.

A fourth object of the invention is to provide an electronic control cooking apparatus which informs by an information means, such as a buzzer, the interruption duration of the heating for turning over the food on the way of thawing and heating, thereby thawing the food reliably, in a short time, and without thawing non-uniformity.

The above and further objects and features of the invention will more fully be apparent from the following detailed description with reference to accompanying drawings.

DETAILED DESCRIPTION OF THE PREFERRED EMBODIMENT

Next, an embodiment of an electronic contrlo cooking apparatus of the invention applied to a microwave oven will be detailed.

Figure 2:
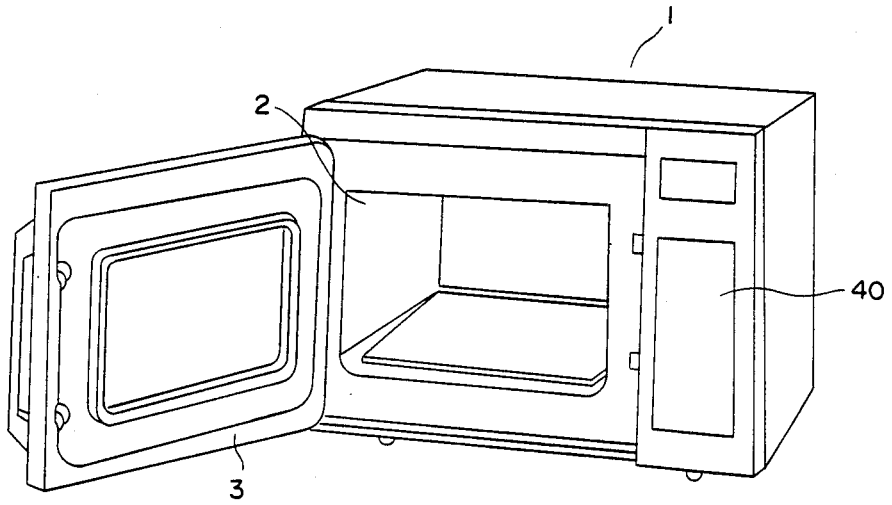
FIG. 2 is an exterior view of the electronic control cooking apparatus of the invention.

FIG. 2 is an exterior view of the electronic control cooking apparatus of the invention for example the microwave oven. A microwave heating chamber 2 is provided in the body 1 of the microwave oven and at the front leftward surface of the body 1 is provided a door 3 for opening and closing the front opening of the microwave heating chamber 2 and at the front rightward surface is provided an operation panel 40 which includes a key board and comprises a key operation unit 4 therebehind.

Figure 3:
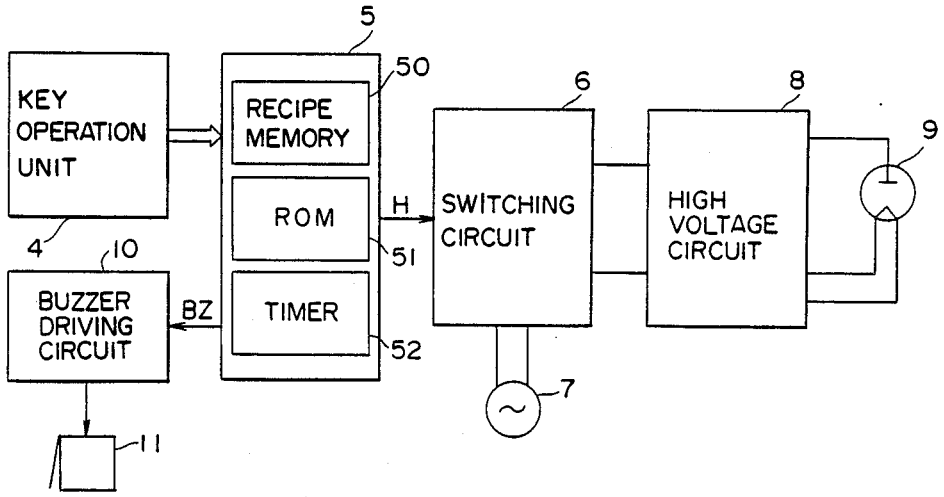
FIG. 3 is a block diagram thereof.

FIG. 3 is a block diagram of the microwave oven, in which a microcomputer 5 is used as the controller for the microwave oven of the invention.

The microcomputer 5 is provided with a ROM 51 for storing a number of recipe programs and various data, a recipe memory 50 which reads-in the recipe program to be executed from the ROM 51 or temporarily stores the recipe program set by operating a key at a key board of the operation panel 40, and a region of a timer 52 for the time counting. Also, the microcomputer 5 outputs a heating signal H to a switching circuit 6 and a buzzer signal BZ to a buzzer driving circuit 10.

The switching circuit 6 comprises a bidirectional thyristor or the like and is on when given the heating signal H from the microcomputer 5, thereby feeding the electric power from a commercial power source 7 to a high voltage circuit 8.

The high voltage circuit 8 comprises a high voltage transformer or the like, and as stated above, when given from the commercial power source 7, a high voltage is fed to a magnetron 9. Upon energizing the magnetron 9, a microwave is supplied to the aforesaid microwave heating chamber 2 to thereby heat the food.

On the other hand, the buzzer signal BZ output from the microcomputer 5 is given to the buzzer driving circuit 10, thereby actuating a buzzer 11.

Figure 1:
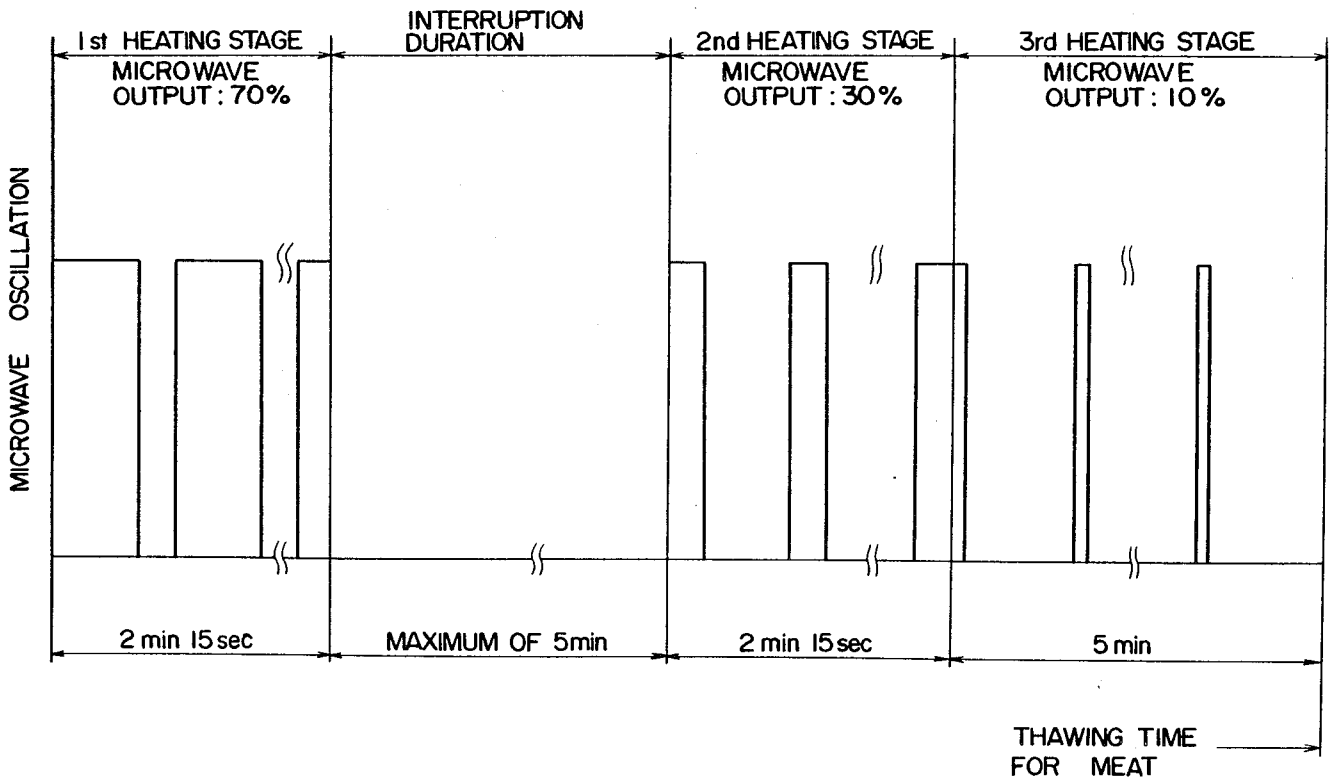
FIG. 1 is a schematic typical view of a thawing program for meat by an electronic control cooking apparatus of the invention.

Next, explanation will be given on operation of the microwave oven of the invention constructed as above-mentioned, in accordance with the FIG. 1 typical view showing the outline of the recipe program for meat thawing of the standard weight of 900 g.

The meat thawing program comprises the first, the second and the third heating stages, the first heating stage heating the meat with the maximum microwave energy (output) of 70% for 2 min 15 sec, the second heating stage with the same of 30% for 2 min 15 sec, and the third heating stage with the same of 10% for 5 min.

While, the microcomputer 5, upon completion of the first heating stage, once interrupts the execution of the thawing program above-mentioned. Thereafter, when the user turns over the meat and reoperates the cooking, the microcomputer 5 executes again the thawing recipe program after the second heating stage.

On the other hand, after the first heating stage is over, in the case where the user does not restart the cooking operation, the microcomputer 5 conducts the time counting by the timer 52, and reexecutes the thawing recipe program from the second heating stage when the heating interruption duration comes to five minutes.

Figure 4:
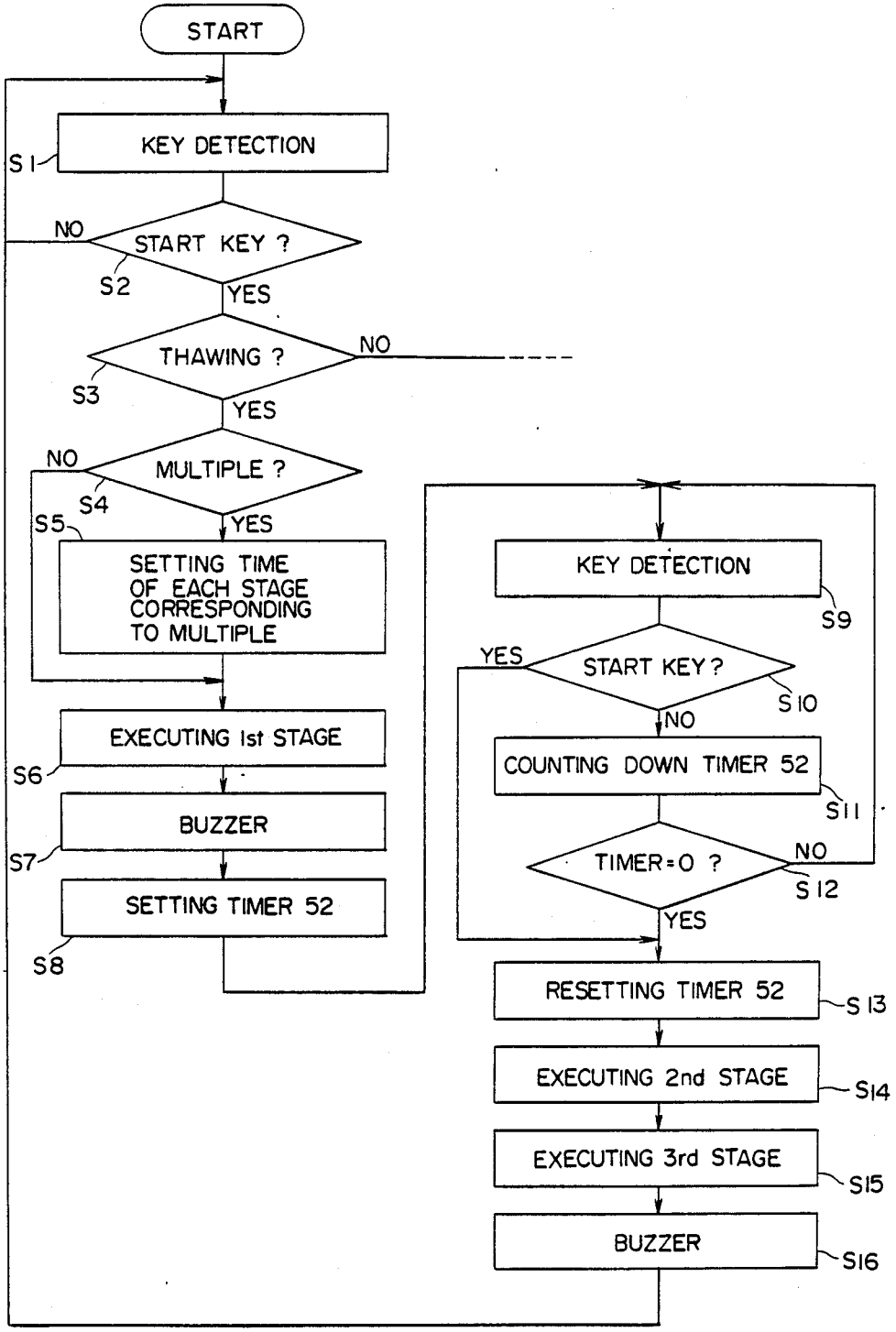
FIG. 4 is a flow chart showing the processing contents of a microcomputer as the controller.

FIG. 4 is a flow chart of the processing contents of the microcomputer 5 for controlling the aforesaid operation of the microwave oven.

The processing of the microcomputer usually circulates steps $S_1$ to $S_2$. The step $S_1$ detects an operated key at the key board of the operation panel 40 and the step $S_2$ decides whether or not the detected key is a start key.

In a case where the user operates the key to set the meat thawing recipe program comprising the aforesaid first, second and third heating stages, or selects a meat thawing recipe program from a number of recipe program stored in the ROM 51 at the microcomputer 5 by keying, the step $S_1$ stores its thawing recipe program into a recipe memory 50, thereafter, when the start key is operated, it is detected in the step $S_2$ and the processing is advanced to the step $S_3$.

The step $S_3$ decides whether or not the recipe program stored in the recipe memory 50 is the thawing recipe program. When it is not the thawing recipe program, the processing is advanced to other step. When it is the thawing recipe program, the processing is advanced to the step $S_4$ and whether or not the multiple input exists is decided.

In the case where the existence of the multiple input is decided at the step $S_4$, the processing is advanced to the step $S_5$, so that the time of each heating stage of the thawing recipe program is set variably corresponding to the introduced multiple. On the other hand, when no multiple input exists, the processing is advanced to the step $S_6$.

Next, the step $S_6$ executes the first heating stage of the thawing recipe program stored in the recipe memory 50 in the microcomputer 5. In this case, concretely, the heating signal H is output for 21 sec in a cycle of 30 sec from the microcomputer 5 to the switching circuit 6. Hence, the microwave output becomes 70%, but such condition continues for 2 min 15 sec, whereby the microwave heating by the output of about 70% is carried out for 2 min 15 sec.

Upon completion of the step $S_6$, the microwave heating is stopped and in the next step $S_7$, the microcomputer 5 outputs the buzzer signal BZ to the buzzer driving circuit 10 for one second, whereby the buzzer acts for one second to inform the user that the first heating stage of the thawing recipe program finishes.

Next, in the step $S_8$, a numerical value corresponding to 5 minutes is set in the timer 52 in the microcomputer 5. The processing of the microcomputer 5 circulates from the step $S_9$ to that $S_{12}$ so that the execution of thawing recipe program, in other words, the microwave heating for the food is interrupted during the circulation of the processing of microcomputer 5.

The steps $S_9$ and $S_{10}$ are like those $S_1$ and $S_2$, at the step $S_{11}$ count down of the timer 52 is carried out by means of a second signal given to the microcomputer from the external circuit (not shown), and at the step $S_{12}$ it is decided whether or not the set numerical value, that is, the residual time, of the timer 52 comes to zero.

Since the buzzer 11 goes to inform the user of the finish of the first heating stage in the thawing recipe program, whereby the user can easily recognize that time has come to turn over the meat under the thawing. Then, the user turns over the meat and thereafter operates the start key, which is detected in the $S_{10}$ and the processing is advanced to the step $S_{13}$.

In the step $S_{13}$, the timer 52 is reset. At the next step $S_{14}$, the second heating stage in the thawing recipe program stored in the recipe memory 50 is executed, and furthermore the third heating stage is executed at the further next step $S_{15}$.

In the second heating stage executed in the step $S_{14}$, the heating signal H is output from the microcomputer 5 to the switching circuit 6 for nine seconds in a cycle of 30 seconds. Hence, the microwave output becomes 30%, but since such condition continues for 2 minutes 15 seconds, the microwave heating is actually carried out by the output of about 30% for 2 minutes 15 seconds.

In the third heating stage executed in the step $S_{15}$, the heating signal H is output from the microcomputer 5 to the switching circuit 6 for every three seconds in a cycle of 30 seconds. Accordingly, the microwave output becomes about 10%. Since such condition continues for five minutes, the microwave heating is performed with the output of about 10% and for five minutes.

In the last step $S_{16}$, the buzzer signal BZ is given from the microcomputer 5 to the buzzer driving circuit 10 for a predetermined time so that the buzzer 11 goes for a predetermined time. Hence, the user recognizes the thawing recipe program of the meat is finished.

As seen from the above, the present invention is able to carry out almost uniform thawing for the meat. When the buzzer informs the finish of the first heating stage, and for the reason of keeping the user apart from the microwave oven, the user may miss hearing of the buzzer 11. In such a case, the user cannot turn over the meat during the thawing, and thereafter operates the start key. Hence, the processing for the microcomputer 5 continues circulation of the step $S_9$ to $S_{12}$, and, when the numerical value of the timer 52 comes to zero, or after the lapse of time for 5 minutes, it is detected in the step $S_{12}$ and the processing advances to the step $S_{13}$. Accordingly, even if the meat is not turned over under the thawing after the completion of the first heating stage in the thawing recipe program, the heating interruption is carried out for five minutes, so that the meat is thawed uniformly in the same way as in the case of the prior art.

In the former embodiment, the meat thawing recipe program has used the meat of 900 g in weight, but the thawing process of meat of, for example, 2700 (900×3) g as the standard amount will be described.

At first, the key at the key board is operated to store into a recipe memory 50 of the microcomputer 5 the thawing recipe program for meat of 900 g as the standard amount. In this case, since the meat of an amount of three times as much as the standard amount is thawed, the numeral key on the key board is operated to introduce into the microcomputer 5 the thawing process for the amount of meat of the three times as much as the standard amount. This operation is detected at the step $S_4$ and the process is advanced to the step $S_5$, in which the heating duration of each heating stage in the thawing recipe program is varied to be set corresponding to the multiple (in this case, three times) to the standard amount previously introduced. The subsequent process is the same as the thawing process in the former embodiment (of course, heating duration of each heating stage is different).

In the case where the meat of three times as much as the standard amount is thawed and cooked, the heating duration in the first heating stage takes much time in comparison with that of the standard amount, but the interruption duration of the heating is similarly five minutes as same as the standard amount. The microwave heating with 70% output in the first heating stage is carried out by the intermittent 100% output, so that the heat transfer is advanced to a certain extent from the high temperature portion to the low temperature portion for a period of carrying out no microwave heating, thereby promoting elimination of the non-uniformity in heating.

Accordingly, the condition of generating non-uniformity, caused by the heating at the first heating stage, scarcely has the relation with the heating duration of the first heating stage. Ultimately, there is no need to change the interruption duration of heating after the first heating process for the thawing of the standard amount or other amounts.

Thus, the interruption duration of heating after completion of the first heating stage in the thawing recipe program needs only to be set to a constant value (five minutes), thereby facilitating control of the microcomputer.

Figure 5:
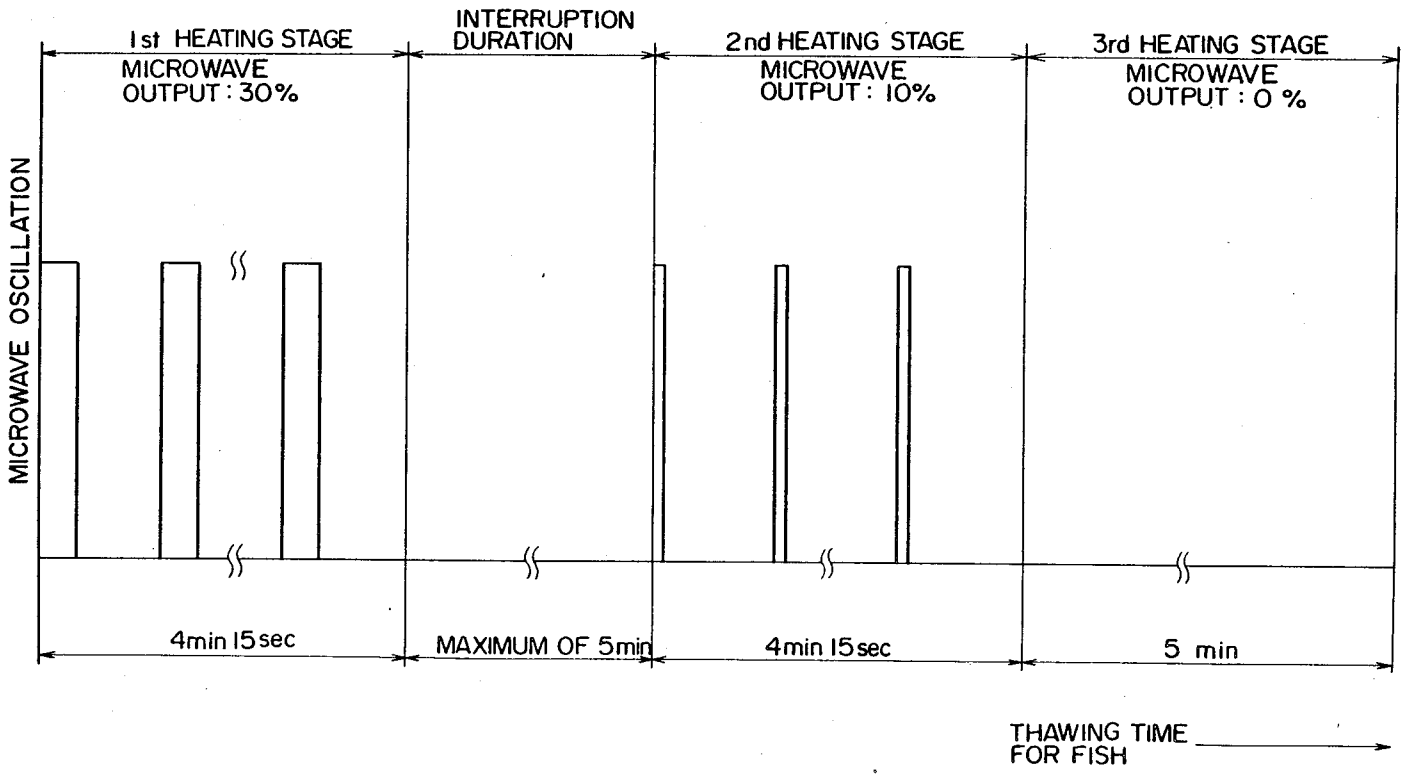
FIG. 5 is a schematic typical view of a thawing program for fish.

Furthermore, the food other than the meat of 900 g in the standard weight in the former embodiment may of course be thawed and cooked uniformly with ease. Next, an example of thawing recipe for a fish of 450 g in standard amount will be described by reference to the FIG. 5 typical view schematically showing the program.

The thawing recipe program for the fish comprises the first, the second and the third heating stages as the same as the above-mentioned meat thawing recipe program, the first heating stage heating the fish with the microwave output of about 30% for 4 min 30 sec, the second heating stage heating the fish with the same of about 10% for 4 min 30 sec, and the third heating stage with the same of about 0% for five minutes. It is a matter of course to interrupt the heating after completion of the first heating stage as the same as the thawing recipe for the meat.

As this invention may be embodied in several forms without departing from the spirit of essential characteristic thereof, the present embodiment is therefore illustrative and not restrictive, since the scope of the invention is defined by the appended claims rather than by the description preceding them and all changes that fall within meets and bounds of the claims, or equivalence of such meets and bounds thereof are therefore intended to be embraced by the claims.

What is claimed is:

1. An electronic control cooking apparatus comprising:

(a) a heating chamber for receiving food to be heated;

(b) an operation unit for setting recipe data for a recipe program or for selecting a recipe program from a number of pre-set recipe programs;

(c) memory means for storing desired recipe program, said desired recipe program including a plurality of heating stages and a predetermined maximum interruption duration occurring between said plurality of heating stages, said desired recipe program being input into said memory means by said operation unit;

(d) heating energy supply means for supplying to said heating chamber heating energy for heating food to be heated; and (e) a controller for controlling the driving of said heating energy supply means in accordance with a desired recipe program stored in said memory means by said operation unit, said controller comprising, (i) interrupting means for automatically interrupting execution of said desired recipe program after a completion of one of said heating stages of the desired recipe program to be executed, and (ii) first execution means which restarts the execution of the desired recipe program from the next stage of said predetermined heating stage, when said operation unit is actuated to restart the heating during the predetermined maximum interruption duration, (iii) second execution means for restarting at the end of the maximum interruption duration the execution of the desired recipe program from the next stage of said predetermined heating stage, when said operation unit is not actuated to restart the heating during the predetermined maximum interruption duration.

2. An electronic control cooking apparatus as set forth in claim 1, wherein each of said heating stages has a set heating duration and said controller further comprises changing means which changes the set heating duration of each of said heating stages corresponding to an amount of the food to be heated.

3. An electronic control cooking apparatus as set forth in claim 1, wherein said maximum interruption duration is constant regardless of the amount of the food to be heated.

4. An electronic control cooking apparatus as set forth in claim 1, wherein said desired recipe program is a program for thawing meat.

5. An electronic control cooking apparatus as set forth in claim 4, wherein said program for thawing meat comprises a first heating stage heating the meat with about 70% of a maximum output of said heating energy supply means, a second heating stage heating the meat with about 30% of the maximum output of said heating energy supply means, and a third heating stage heating the meat with about 10% of the maximum output of said heating energy supply means.

6. An electronic control cooking apparatus as set forth in claim 5, wherein said interrupting means interrupts the execution of said recipe program after completion of said first heating stage.

7. An electronic control cooking apparatus as set forth in claim 6, wherein said interruption duration of execution of said recipe program after a completion of said first heating stage is constant regardless of an amount of the meat to be heated.

8. An electronic control cooking apparatus as set forth in claim 7, wherein said interruption duration is about five minutes.

9. An electronic control cooking apparatus as set forth in claim 5, wherein said controller further comprises a changing means which changes the heating duration of each of said heating stages corresponding to an amount of the meat to be heated.

10. An electronic control cooking apparatus as set forth in claim 1, wherein said desired recipe program is a program for thawing fish.

11. An electronic control cooking apparatus as set forth in claim 10, wherein said program for thawing fish comprises a first heating stage heating the fish with about 30% of a maximum output of said heating energy supply means, a second heating stage heating the fish with about 10% of the maximum output of said heating energy supply means, and a third heating stage heating the fish with about 0% of the maximum output of said heating energy supply means.

12. An electronic control cooking apparatus as set forth in claim 11, whereins aid interrupting means interrupt the execution of said desired recipe program after completion of said first heating stage.

13. An electronic control cooking apparatus as set forth in claim 12, wherein said interruption duration of execution of said recipe program after a completion of said first heating stage is constant regardless of an amount of the fish to be heated.

14. An electronic control cooking apparatus as set forth in claim 13, wherein said interruption duration is about five minutes.

15. An electronic control cooking apparatus as set forth in claim 11, wherein said controller further comprising a changing means which changes the heating duration of each of said heating stages corresponding to an amount of the fish to be heated.

16. An electronic control cooking apparatus as set forth in claim 1, provided with information means for informing the interruption of the desired recipe program.

17. An electronic control cooking apparatus as set forth in claim 1, wherein said heating energy supply means employs a magnetron.

* * * * *